US008793822B2

(12) United States Patent
Martin et al.

(10) Patent No.: US 8,793,822 B2
(45) Date of Patent: Aug. 5, 2014

(54) PATIENT LIFT DEVICE

(75) Inventors: Willis E. Martin, Rocky Mount, NC (US); Rodney Barr, Cary, NC (US)

(73) Assignee: American Sling and Lift Company, LLC, Rocky Mount, NC (US)

( * ) Notice: Subject to any disclaimer, the term of this patent is extended or adjusted under 35 U.S.C. 154(b) by 417 days.

(21) Appl. No.: 13/208,467

(22) Filed: Aug. 12, 2011

(65) Prior Publication Data

US 2012/0291197 A1 Nov. 22, 2012

Related U.S. Application Data

(60) Provisional application No. 61/373,066, filed on Aug. 12, 2010.

(51) Int. Cl.
*A61G 7/10* (2006.01)

(52) U.S. Cl.
USPC ..... 5/81.1 R; 5/83.1; 5/85.1; 5/87.1; 5/86.1; 5/89.1

(58) Field of Classification Search
USPC ..... 5/81.1 R, 83.1, 85.1, 87.1, 88.1, 86.1, 5/89.1; 414/458–461
See application file for complete search history.

(56) References Cited

U.S. PATENT DOCUMENTS

| | | | | |
|---|---|---|---|---|
| 1,536,768 | A * | 5/1925 | Casler | 280/87.01 |
| 2,368,390 | A * | 1/1945 | Winter | 5/86.1 |
| 2,544,593 | A | 3/1951 | Feist | |
| 2,688,410 | A * | 9/1954 | Nelson | 212/343 |
| 3,042,936 | A | 7/1962 | Patterson | |
| 4,334,480 | A * | 6/1982 | Wallace | 104/126 |
| 6,206,127 | B1 * | 3/2001 | Zakula et al. | 180/236 |
| 8,099,806 | B2 * | 1/2012 | Chepurny et al. | 5/81.1 R |
| 2002/0071751 | A1 * | 6/2002 | Brice et al. | 414/458 |
| 2003/0161708 | A1 * | 8/2003 | Johnston | 414/460 |
| 2007/0108150 | A1 * | 5/2007 | Oja | 212/324 |
| 2012/0011650 | A1 * | 1/2012 | Chepurny | 5/85.1 |
| 2012/0159706 | A1 * | 6/2012 | Capaldi | 5/85.1 |

FOREIGN PATENT DOCUMENTS

| | | | |
|---|---|---|---|
| GB | 740396 | A | 11/1955 |
| WO | 2005032446 | A1 | 4/2005 |

* cited by examiner

*Primary Examiner* — William Kelleher
(74) *Attorney, Agent, or Firm* — Coats and Bennett, P.L.L.C.

(57) ABSTRACT

A patient lifting and transfer device is shown which includes a pair of vertical columns having a horizontal bar connected between the two columns. There is provided a mobile support that is rotatively mounted to the lower portion of each vertical column. Each mobile support is elongated and rotatable from a first position where the elongated mobile support extends generally perpendicular to the horizontal bar to a second position where the mobile supports extend generally parallel to the horizontal bar. In the second position, the patient lifting and transport device is relatively narrow and can be moved through close quarters and also stored in relatively small areas.

20 Claims, 6 Drawing Sheets

PATIENT LIFT DEVICE

CROSS REFERENCE TO RELATED APPLICATION

This application claims priority under 35 U.S.C. §119(e) from the following U.S. provisional application: Application Ser. No. 61/373,066 filed on Aug. 12, 2010. That application is incorporated in its entirety by reference herein.

FIELD OF THE INVENTION

The present invention relates to lifting and moving patients. The present invention also entails a patient lifting and transfer device comprising a pair of vertical columns having a horizontal bar connected between the two columns. In addition, there is provided a mobile support that is rotatably mounted to the lower portion of each vertical column. Each mobile support is elongated and rotatable from a first position where the elongated mobile support extends generally perpendicular to the horizontal bar to a second position where the mobile supports extend generally parallel to the horizontal bar. In the second position, the patient lifting and transport device is relatively narrow and can be moved through close quarters and also stored in relatively small areas.

BACKGROUND

Health care workers and their patients face problems related to lifting and moving non-ambulatory patients. Health care workers face possibilities of injuries to themselves in lifting such patients. Patients as well are often subjected to potential injuries in the process of being lifted and moved. Additionally, extant devices and systems for assisting or facilitating the lifting and moving of such patients often subject the patient to disconcerting fear as well as humiliation. Being, for example, slung under a hoist with lifting cranks or motors suspended overhead is often a source of fear. Moreover, such extant devices often include configurations that are ungainly to use, difficult to move through doorways and negotiate past obstacles, and bulky to store.

There is a need for a patient lifting device that respects the sensibilities of patients, provides a stable and secure lifting arrangement, is easy to maneuver and operate, and is capable of being efficiently stored.

SUMMARY OF THE INVENTION

The present invention entails a device for lifting and moving a patient with respect to a bed, wheelchair, table, or the floor. The patient lift device includes a generally arched superstructure supported on mobile trolleys. The superstructure includes a lifting beam supported by a pair of variable height columns. The lifting beam carries a suspensory trolley for suspending a sling holding a patient. The suspensory trolley is movable along the beam to laterally position the patient while the variable height columns provide vertical patient movement.

The present invention also entails a device for lifting and moving a patient that provides an upper patient support structure and a driver system for vertically moving the patient. The upper patient support structure is configured to support the patient away from the driver system.

The present invention further entails a device for lifting and moving a patient that provides an upper patient support structure and a lifting driver system, which are supported on movable transport trolleys that enable unrestricted movement of the device about a generally horizontal support surface. The transport trolleys are pivotable about vertical axes to permit changing the footprint of the device for storage and transport.

The present invention provides a method of lifting and transporting a patient with a patient lift device, the method including extending an arched structure over the patient. The method further includes securing the patient to an upper portion of the arched structure and raising the arched structure to lift the patient. The method further includes disposing the patient away from lift driving assemblies comprised in the patient lift device while lifting and moving the patient. Moving the patient includes transporting the arched structure on transport trolleys comprised in the patient lift device.

The present invention also entails a patient lifting and transfer device comprising a pair of vertical columns having a horizontal bar connected between the two columns. In addition, there is provided a mobile support that is rotatably mounted to the lower portion of each vertical column. Each mobile support is elongated and rotatable from a first position where the elongated mobile support extends generally perpendicular to the horizontal bar to a second position where the mobile supports extend generally parallel to the horizontal bar. In the second position, the patient lifting and transport device is relatively narrow and can be moved through close quarters and also stored in relatively small areas.

Other objects and advantages of the present invention will become apparent and obvious from a study of the following description and the accompanying drawings which are merely illustrative of such invention

DESCRIPTION OF THE INVENTION

Figure 1:
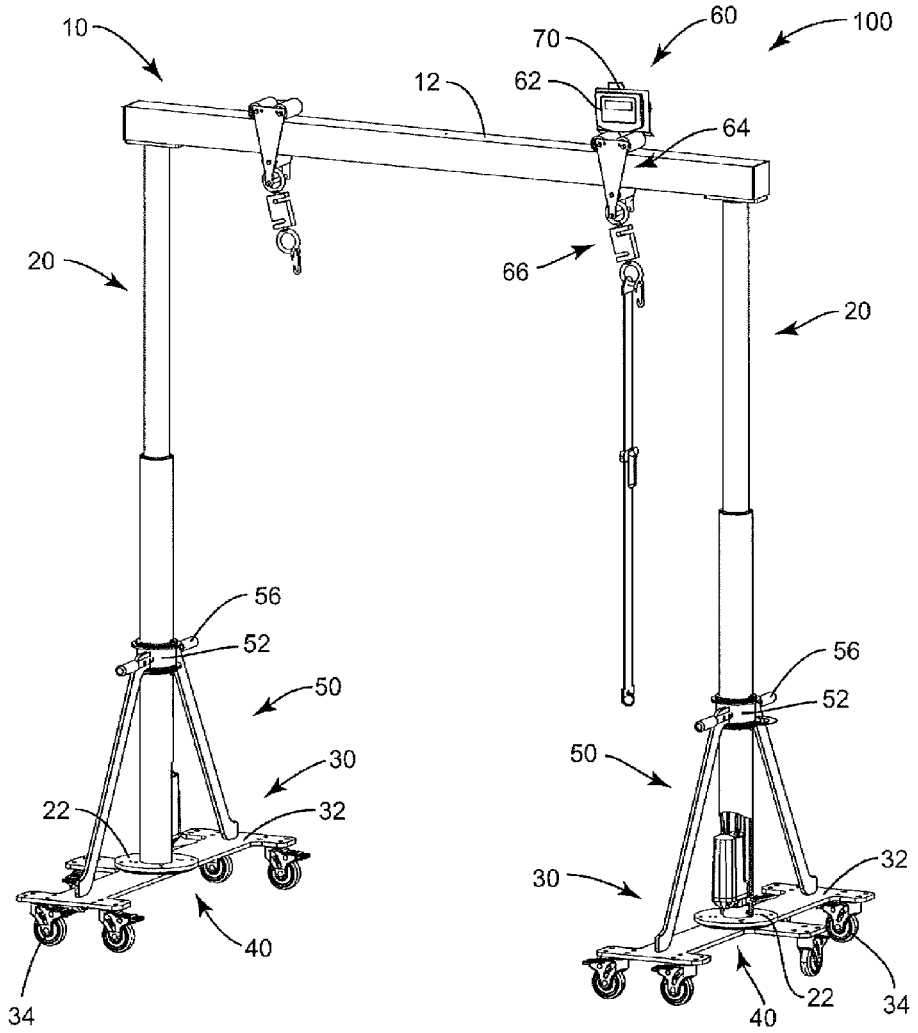
FIG. 1 is a perspective view of an embodiment of the patient lift device.

The present invention entails a patient lift device, indicated generally by the numeral 100 and illustrated generally in FIG. 1. Patient lift device 100 comprises an arched superstructure that is movable over a generally horizontal surface. In particular, the patient lift device 100 comprises an upper support structure 10 interconnected with and supported by a pair of support or vertical lift columns 20. Each support column 20 rests upon a transport trolley 30. Upper support structure 10 includes a cross beam or bar 12, with each end thereof supported on a respective one of the support columns 20. Each support column 20 is connected to a lifting drive assembly or lift actuator 40. Riding on cross beam 12 is a suspensory trolley 60 from which a patient may be suspended as will be described herein. Once suspended, the patient may be lifted and laterally moved by actuating the drive assemblies 40 to raise cross beam 12.

Figure 2:
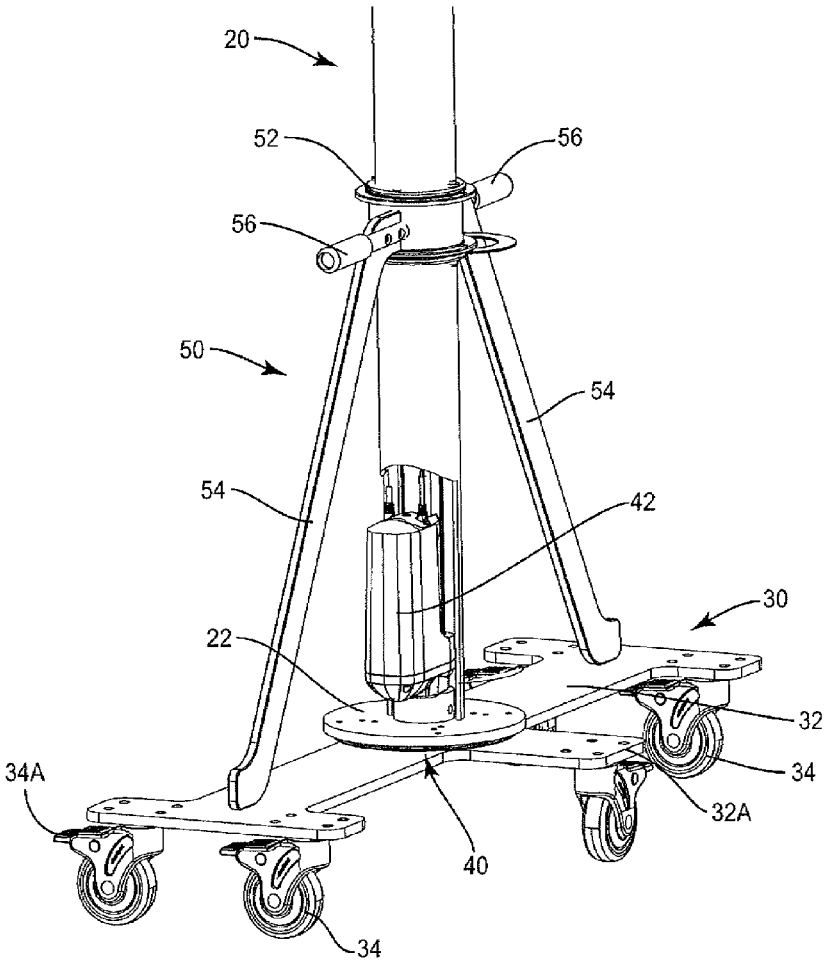
FIG. 2 is a fragmentary perspective view of upper portion of an embodiment of the patient lift device.

Each transport trolley 30 includes a generally elongated carriage 32 supported by a series of casters 34 of common design mounted thereunder as can be further appreciated from FIG. 2. A base flange 22 of each support column 20 rests on the respective carriage 32. Each transport trolley 30 is journalled to the corresponding support column 20 by a transport trolley pivot assembly 50 and by engagement of a lower portion of the column with carriage 32. Journalled connection of transport trolley 30 with support column 20 enables pivoting or turning transport trolley 30 about a generally vertical axis of column 20 and locking the trolley in either of two angular relationships with cross beam 12. For example, each transport trolley 30 may be pivoted or swiveled to and locked in a position such that elongated carriage 32 is generally normal to cross beam 12 to provide stable support for an operable mode lifting configuration of patient lifting device 100. As another example, each transport trolley 30 may be swiveled and locked in a position so that elongated carriage 32 is generally parallel with cross beam 12 to provide for compact transport and storage mode of patient lift device 100 while not in use. It is appreciated that transport trolley 30 may be locked in various other angular positions as well.

Trolley pivot assembly 50 includes handles 56, shown at least in FIG. 2, which may be gripped by a person operating or moving patient lift device 100 in order to turn or swivel the trolley. Locking of transport trolley in a particular angular position may be provided by any of a number of well known means. For example, it is well known that portions of handles 56 may be threaded through collar 52 and configured to seat against support column 20. In accordance with well known design practice, depressions or flats may be provided on the outer surface of column 20 to provide for detented registering in pre-defined angular orientations of transport trolley such as normal to cross beam 12 for operating patient lift device 100 to lift a patient safely or parallel to the cross beam for device transport and storage when not in use.

As can be appreciated at least from FIG. 2, casters 34 are arrayed so as to provide stable support of patient lift device 100. In the illustrated embodiment, casters 34 are arrayed in a pattern where one of the casters is affixed to a lateral extension 32A of undercarriage 32 so that this particular caster is side shifted from the remaining four casters. This arrangement provides for stability of patient lift device 100 when configured for device transport and storage. Moreover, such an arrangement of casters 34 provides additional stability to patient lift device 100 when in the operable, patient lifting mode as also described above. At least one of the casters 34 of each transport trolley 30 is equipped with a lock 34A of common design for preventing unwanted movement of patient lift device 100.

Figure 3:
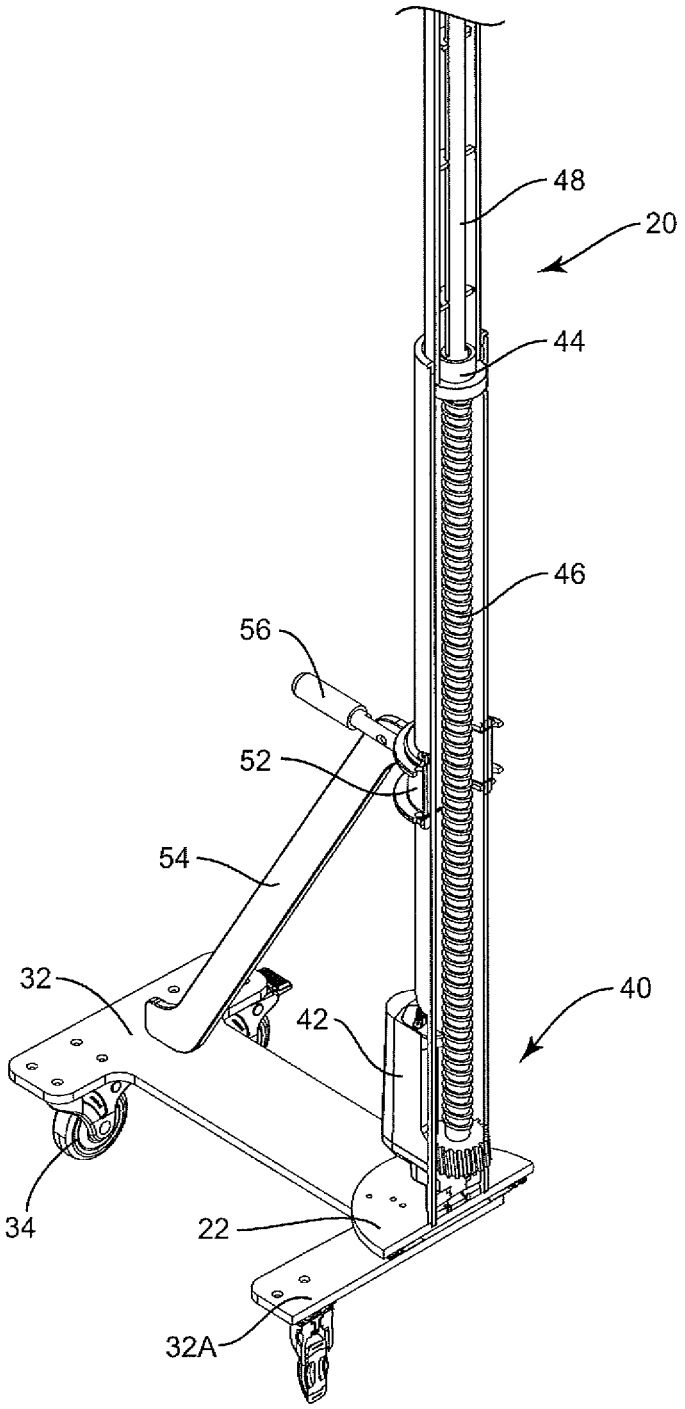
FIG. 3 is a fragmentary cross-sectional view of a support column, transport trolley assembly, and lifting drive assembly of an embodiment of the patient lift device.

It is appreciated that carriage 32 of transport trolley 30 may be configured as a generally elongated plate or tube formed of stainless steel or other ferrous metal protected from corrosion. Carriage 30 may be formed from plate or tube stock, and casters 34 may be mounted directly underneath the plate as illustrated in FIG. 2. Alternatively, for example, each caster 34 may be mounted to an intervening bracket that can be mounted to the plate of carriage 30 as shown in FIG. 3 where a portion of the plate is removed.

In one embodiment, a lifting drive assembly 40 is supported at a lower end of each support column 20. The lifting drive assemblies 40 are configured to movably position upper support structure 10 vertically. Lifting drive assembly 40 is of a commercially-available linear actuator design that comprises a ball screw actuator powered by a servomotor 42. See FIG. 2. Electrical operation controls of well known design may be deployed to provide actuation control of lifting drive assemblies 40. Lifting drive assemblies 40 are deployed in patient lift device 100 to raise and lower crossbeam 12 and to raise and lower a patient connected to the cross beam as will be described in more detail hereinafter. As may be appreciated from FIG. 3, assembly 40 further comprises a collar 44 threadingly engaged with a threaded screw shaft 46 coupled to a telescoping portion 48 of support column 20. Rotating shaft 46 in one direction by actuation of servomotor 42 drives telescoping portion 48 in an upward direction to raise cross beam 12 to lift a patient supported thereby. Counter-rotation of shaft 46 correspondingly moves cross beam 12 downward to lower a patient thereby supported.

Figure 4:
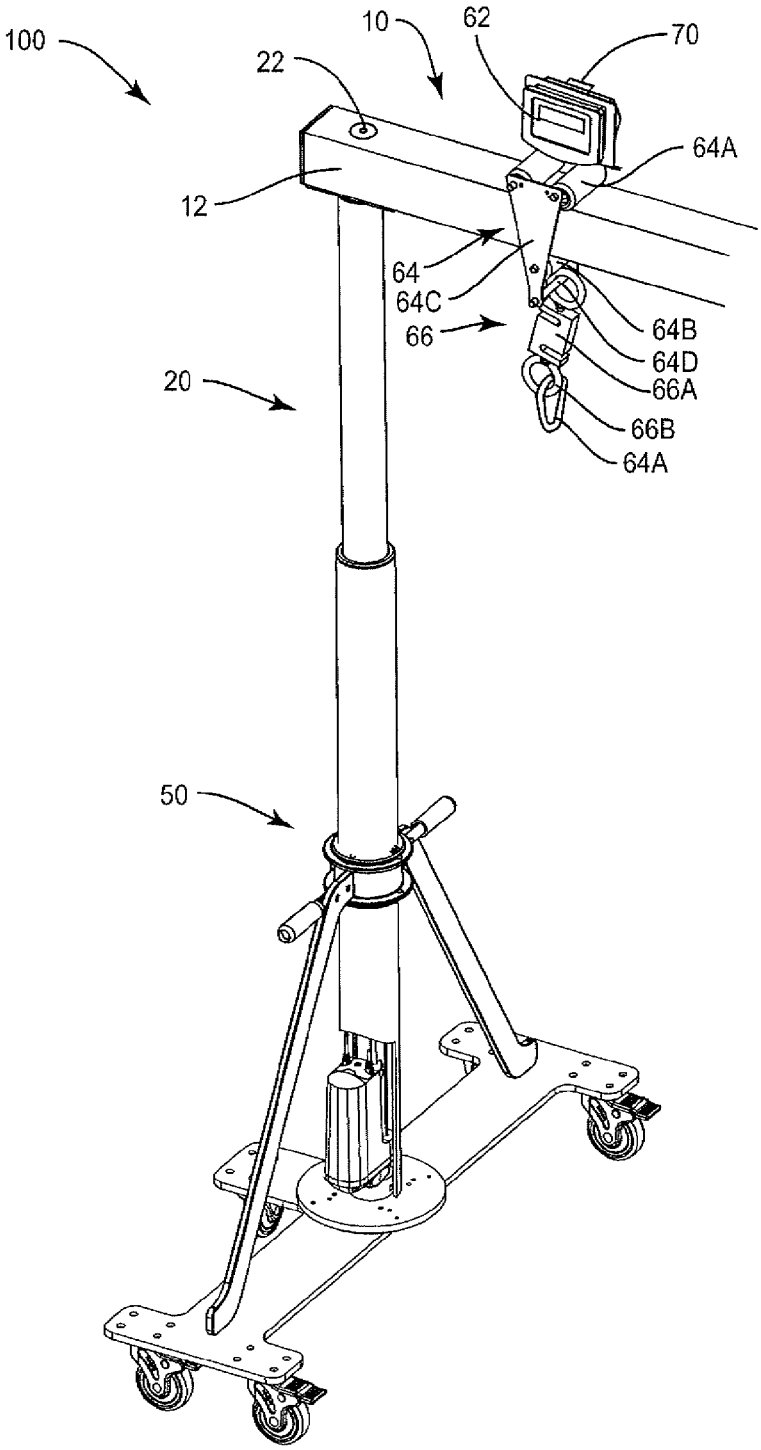
FIG. 4 is a fragmentary perspective view of an upper portion of an embodiment of the patient lift device.

Turning now to the upper portion of patient lift device 100 and referring more particularly to FIG. 4, it is appreciated that one of the telescoping members 22 is secured within an opening on each end of cross beam 12. Further, with the aid of FIG. 3 it is appreciated that when cross beam 12 is in its lowest position, the cross beam rests against upper ends of support columns 20. When cross beam 12 is elevated, as described here above, the cross beam is supported by telescoping members 22.

As configured in the embodiment of FIGS. 1-4, it is appreciated that lifting drive assemblies 40 are disposed downwardly and horizontally away from the patient. This arrangement provides for avoidance of negative reactions by the patient to any noise or movement of the assemblies.

Figure 5:
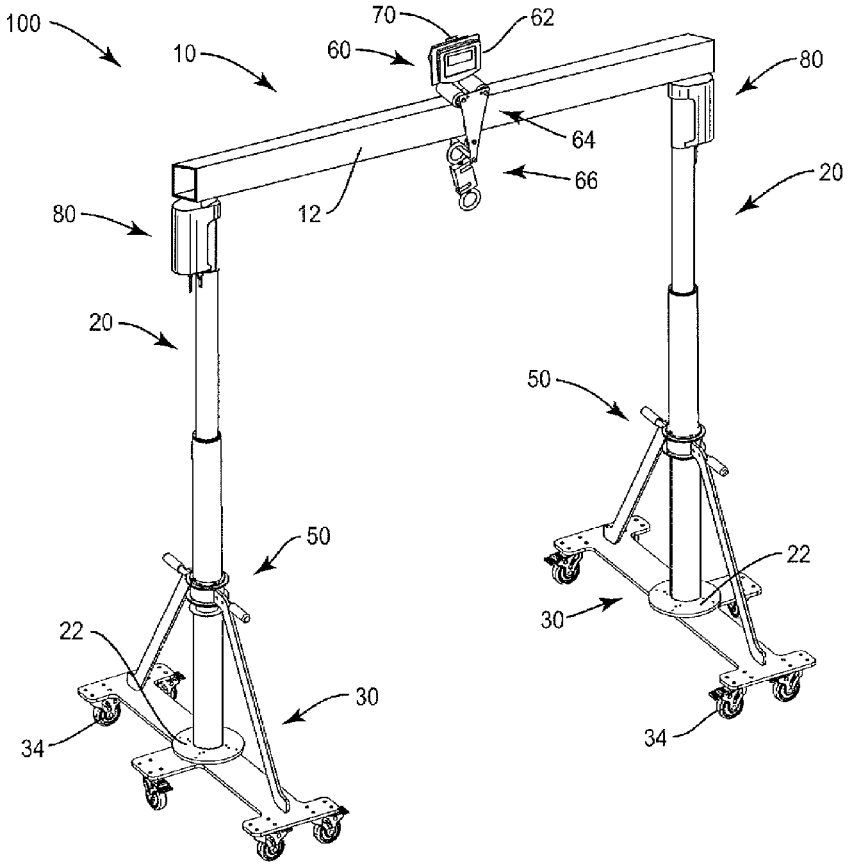
FIG. 5 is a perspective view of an alternate embodiment of the patient lift device.
Figure 6:
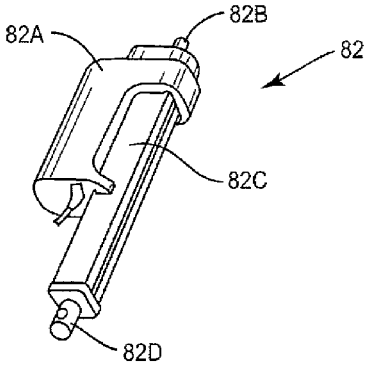
FIG. 6 is a perspective view of an exemplary linear actuator utilized in the embodiment of FIG. 5.
Figure 7:
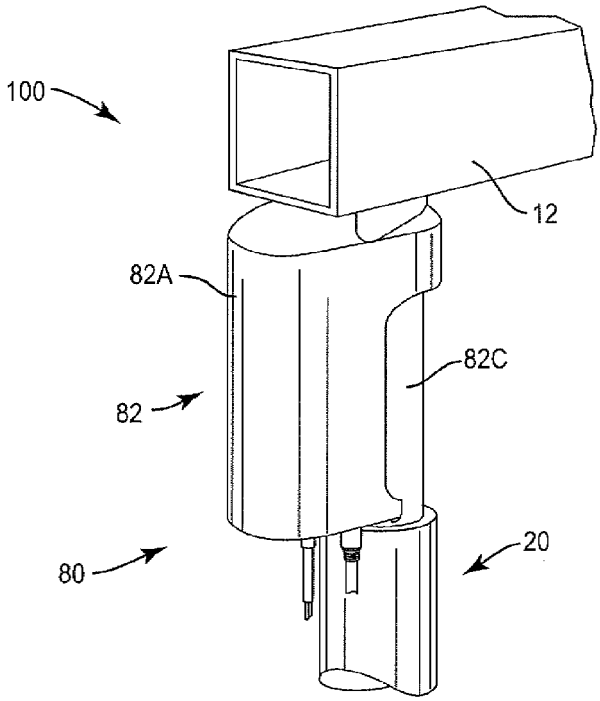
FIG. 7 is a fragmentary perspective view of an upper portion of the embodiment of FIG. 5.

It is appreciated that other configurations of linear actuators may be employed in patient lift device 100 of the present invention. For example in the embodiment illustrated in FIGS. 5-7, patient lift device 100 provides a differently disposed, compact lifting drive assembly 80 in the alternative to assembly 40 of the embodiment illustrated in FIGS. 1-4. Lifting drive assembly 80 comprises a linear actuator 82, an example of which includes Actuator LA36 manufactured by Linak (http://www.linak.com/) illustrated in FIG. 6. Actuator 82 includes a housing 82A with a mounting stud 82B for securing the actuator to a portion of a structure to be moved by the actuator. As can be appreciated by an ordinarily skilled mechanic, mounting stud 82B can be secured to cross beam 12 by any of a number of well known methods. Actuator 82 also includes a rod guide 82C and a rod 82D. Rod 82D is extended and retracted by the action of a permanent magnet motor comprised in actuator 82. The ordinarily skilled mechanic can likewise appreciate that rod 82D may be connected to one of the support columns 20 by any of a number of well known methods such that when the rod extends, cross beam 12 is raised and when the rod retracts the cross beam is lowered. As shown in FIG. 7, a portion of rod guide 82C may extend within an upper portion of support 20, and rod 82D may be secured interiorly to the support (not shown). It is appreciated that this kind of compact actuator and its placement horizontally away from the patient provides for avoidance of negative reactions by the patient to any noise or movement of the assemblies.

Figure 8:
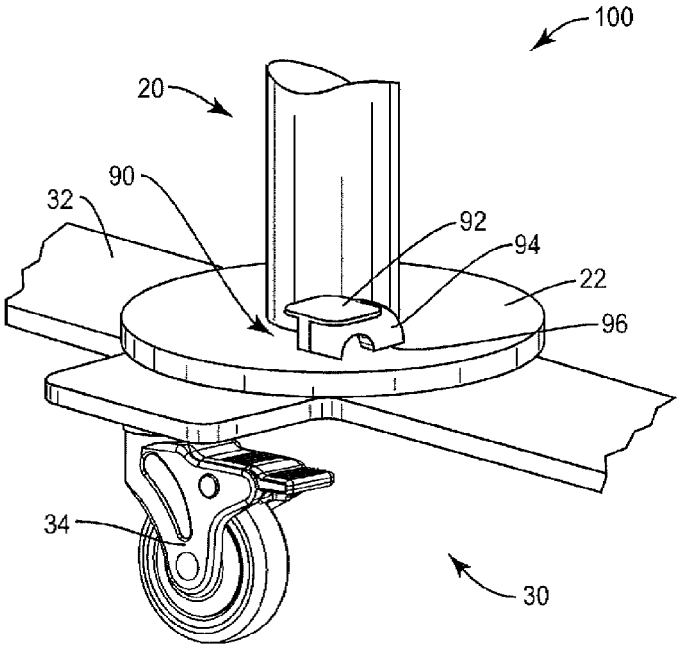
FIG. 8 is a fragmentary perspective view of a lower portion of the patient lift device.

Illustrated in FIG. 8 is an example of an alternative transport trolley locking device 90 to enable foot-operated unlocking of transport trolley 30 for swiveling between operative and storage modes. Locking device 90 includes a foot pedal 92 connected to a locking pawl 94 that extends into a slot in base flange 22 of support column 20. In one embodiment, pawl 94 may be spring loaded using well known methods in a locked position such that the pawl interferes with a surface on carriage 32 to lock the carriage to the base plate. Depressing foot pedal 92 disengages locking pawl 94 from carriage 32 to permit swiveling of transport trolley 30. While the illustration of FIG. 8 shows alternative transport trolley locking device 90 in the context of the embodiment of patient lift device 100 illustrated in FIGS. 5-7, it is appreciated that the alternative locking device can be deployed on base flanges 22 of the embodiment of FIG. 3.

Turning more particularly to suspensory trolley 60, as here before mentioned, the suspensory trolley rides on cross beam 12 and serves to suspend a patient from the cross beam. Suspensory trolley 60 comprises a yoke assembly 64 that receives cross beam 12 and is movable along the length of the cross beam. Assembly 64 comprises a pair of spaced apart side plates 64C supporting corresponding ends of upper rollers 64A and lower roller 64B. It is appreciated that assembly 64 forms an opening shaped and sized to receive the cross beam 12 and permit movement of suspensory trolley 60 along the cross beam so as to move a suspended patient from side to side. See FIG. 4.

In one embodiment, a load sensor 66 may be connected to suspensory trolley 60 to enable weighing a patient suspended there from. Load sensor 66 is of know commercial design that may, for example, include an active element 66A connected to attachment rings 66B. Upper attachment ring 66B is secured to suspensory trolley 60 by engagement with pin 64D as shown in FIG. 4. Lower attachment ring 66B is engaged with link 68 which is secured to the patient sling (not shown). By well known means not shown, sensor 66 is interfaced with a display module 62 that is mounted on the suspensory trolley, the use of which permits observation of the weight of the lifted patient. Those of ordinary skill will appreciate that the interfacing means may commonly include the capability of tare weight adjustment to compensate for the weights of suspended items other than the patient.

Deployed with patient lift device 100 are one or more obstruction sensors 70 of common design configured to signal and prevent interference of the upper portion of the device with obstructions such as light fixtures or other overhead structures that may be found in a hospital room, treatment, room, or any other environment in which the device is utilized to lift a patient. A sensor 70 may, for example, be a contact device which is activated by a feeler contacting with an obstruction in the course of a patient being lifted. A sensor 70, as another example, may be a proximity device that senses an approach to an obstruction by interruption of a light beam or by reflected radiation. Such sensors may be deployed about the upper portion of device 100 and electronically incorporated within well known controls (not shown) for controlling lifting drive assemblies 40 to safely stop lifting action in the event of an obstruction.

Patient lifting device 100 may be utilized to lift a non-ambulatory patient or to lift and move the patient from a bed, a wheel chair, an examination or treatment table or the floor. It is sufficient to describe the processes of use of device 100 in the context of lifting a patient from a bed to, for example, permit changing bed linens. To use device 100, the device may be moved from storage where it would have been configured with transport trolley assemblies 30 rotated into alignment with cross beam 12. Prior to positioning device 100 for operation, transport trolley assemblies 30 are swiveled into positions generally normal to cross beam 12 and locked into position. Device 100 is them rolled in to position such that the device straddles the bed with one of the support columns 20 on one side of the bed and the other support column on the other side of the bed and cross beam 12 is disposed over the patient. The patient is recumbent on a sling of well known design, with supporting band having been slid under the patient. Suspensory trolley 60 may then be moved to laterally position the trolley over the patient. The sling may then be connected to link 68 using, for example, a four-point carry or lift bar of well known design. Such arrangements are well known and operable to provide stable and secure patient engagement for lifting.

After the patient sling is secured to link 68, lifting drive assemblies 40 may be actuated to lift the patient to the desired height, for example, to clear the upper surfaces of the bed. If desired, the patient may be gently shifted to one side or the other by manually pushing suspensory trolley 60 in one direction or the other. Further, and if desired, device 100, with the patient suspended thereby, may be moved away from the bed by manually pushing or pulling and moving it on casters 34 of transport trolleys 30.

While the patient is thusly suspended by an embodiment of device 100 that incorporates sensor 66 and display module 62, the weight of the patient may be observed and recorded as needed. Such weighing is of utility in many patient care situations.

After the bed is prepared to again receive the patient, device 100 may be repositioned relative to the bed in a manner similar to its initial positioning as described above. As needed, the suspended patient may be shifted laterally by moving suspensory trolley 60 as described above. Lifting drive assemblies 40 may then be actuated to gently lower the patient into the bed after which the sling may be disconnected from link 68. Device 100 may then be rolled away from the bed and moved for use elsewhere or for storage. In the course of movement and for storage, transport trolleys 30 may be swiveled and locked in the transport or storage mode to facilitate movement of device 100 through doors and to enable compact storage.

The present invention may, of course, be carried out in other specific ways than those herein set forth without departing from the scope and the essential characteristics of the invention. The present embodiments are therefore to be construed in all aspects as illustrative and not restrictive.

The invention claimed is:

1. A patient lifting and transport device for lifting and transporting a patient from one location to another location, the patient lifting and transport device comprising:

a pair of spaced apart vertical lift columns, each vertical lift column including an upper portion and lower portion;

a horizontal bar extending generally horizontally between the upper portions of the two vertical lift columns, the bar being supported by the vertical lift columns;

a mobile trolley including a series of wheels disposed below the lower portion of each vertical lift column for supporting the lift column;

each mobile trolley being generally elongated as each mobile trolley includes a length that is greater than the width of the mobile trolley;

each mobile trolley being rotatively mounted below a respective vertical lifting column and rotatable between a first position where the mobile trolley extends generally perpendicular to the horizontal bar and a second position where the mobile trolley extends generally parallel to the horizontal bar;

a lift actuator associated with each vertical lift column for raising and lowering the vertical lift column such that the lift actuator associate with each vertical lift column is operative upon actuation to raise and lower the horizontal bar; and a patient attachment mechanism supported by the horizontal bar for attaching to the patient or to a support structure supporting the patient.

2. The patient lifting and transport device of claim 1 further including a collar rotatively mounted about a vertical axis of each lift column, and wherein there is provided a pair of supports secured to each collar and extending downwardly therefrom to a respective mobile trolley.

3. The patient lifting and transport device of claim 1 wherein the mobile trolley includes five wheels, and wherein four of the wheels are aligned, and one wheel is offset with respect to the wheels that are aligned.

4. The patient lifting and transport device of claim 1 wherein the patient attachment mechanism suspended on the horizontal bar includes a trolley that is movable back and forth on the horizontal bar.

5. The patient lifting and transport device of claim 1 wherein the lift actuator associated with each vertical lift column comprises a linear actuator.

6. The patient lifting and transport device of claim 1 wherein each lift actuator associated with each vertical lift column comprises a servomotor operative to vertically move an elongated shaft forming a part of the vertical lift column, and wherein the actuation of the servomotor is effective to move the elongated shaft forming a part of each vertical lift column up and down.

7. The patient lifting and transport device of claim 6 wherein each lift actuator further includes a ball screw nut, and wherein the servomotor is operative to drive the ball screw nut which is in turn operative to move the elongated shaft associated with the vertical lift column up and down.

8. The patient lifting and transport device of claim 1 wherein each vertical lift column includes a plurality of telescoping sections and wherein the lift actuator associated with each vertical lift column is operative to extend and retract the telescoping sections.

9. The patient lifting and transport device of claim 1 wherein the lift actuator associated with each vertical lift column comprises a linear actuator including a rod movably mounted in a rod guide and wherein the linear actuator is operative to move the rod in the rod guide; and wherein the rod is operatively connected to the horizontal bar such that actuation of the linear actuator results in the horizontal bar being moved vertically up or down.

10. The patient lifting and transport device of claim 9 wherein the linear actuator is mounted adjacent to an upper portion of each vertical lift column.

11. The patient lifting and transport device of claim 1 including a plate that forms an interface between each vertical lift column and a respective mobile trolley, and wherein associated with the plate is a lock that is effective to lock the mobile trolley with respect to the vertical lift column.

12. The patient lifting and transport device of claim 11 further including a foot actuator operatively associated with the locking pawl for actuating the locking pawl.

13. The patient lifting and transport device of claim 12 wherein the locking pawl is normally biased to assume a locked position resulting in the mobile trolley being locked with respect to the adjacent vertical lift column, and wherein the actuation of the foot actuator causes the locking pawl to assume a released position which enables the mobile trolley to be rotated with respect to the adjacent vertical lift column.

14. A patient lifting a transport device comprising:

(a) a pair of spaced apart vertical columns with each column having an upper portion and a lower portion;

(b) a horizontal bar connected to the upper portion of the vertical columns;

(c) a pair of mobile supports with each mobile support connected to a lower portion of a respective vertical column;

(d) each mobile support being elongated and including a series of wheels; and (e) each mobile support being rotatively mounted to the lower portion of a respective vertical column and rotatable from a first position where the elongated mobile support extends generally perpendicular to the horizontal bar and a second position where the elongated mobile support extends generally parallel to the horizontal bar such that in one mode of operation the elongated mobile supports are rotated such that the mobile supports extend perpendicular to the horizontal bar and give rise to a relatively wide patient lifting and transport device, and in another mode of operation the elongated mobile supports are rotated such that the mobile supports extend generally parallel to the horizontal bar giving rise to a relatively narrow patient lifting and transport device.

15. The patient lifting and transport device of claim 14 further including an electric actuator associated with each lift column for raising and lowering the lift column and consequently raising and lowering the horizontal bar connected to the upper portions of the vertical columns.

16. A patient lifting and transport device for lifting and transporting a patient from one location to another location, the patient lifting and transport device comprising:

a pair of spaced apart vertical lift columns, each vertical lift column including an upper portion and lower portion;

a horizontal bar extending generally horizontally between the upper portions of the two vertical lift columns, the bar being supported by the vertical lift columns;

a mobile trolley including a series of wheels disposed below the lower portion of each vertical lift column for supporting the lift column;

each mobile trolley being generally elongated as each mobile trolley includes a length that is greater than the width of the mobile trolley;

each mobile trolley being rotatively mounted below a respective vertical lifting column and rotatable between a first position where the mobile trolley extends generally perpendicular to the horizontal bar and a second position where the mobile trolley extends generally parallel to the horizontal bar;

a lift actuator associated with each vertical lift column for raising and lowering the vertical lift column such that the lift actuator associate with each vertical lift column is operative upon actuation to raise and lower the horizontal bar;

a patient attachment mechanism supported by the horizontal bar for attaching to the patient or to a support structure supporting the patient; and a plate that forms an interface between each vertical lift column and a respective mobile trolley, and wherein associated with the plate is a lock that is effective to lock the mobile trolley with respect to the vertical lift column.

17. The patient lifting and transport device of claim 16 further including a collar rotatively mounted about a vertical axis of each lift column, and wherein there is provided a pair of supports secured to each collar and extending downwardly therefrom to a respective mobile trolley.

18. The patient lifting and transport device of claim 16 wherein the mobile trolley includes five wheels, and wherein four of the wheels are aligned, and one wheel is offset with respect to the wheels that are aligned.

19. The patient lifting and transport device of claim 16 wherein each vertical lift column includes a plurality of telescoping sections and wherein the lift actuator associated with each vertical lift column is operative to extend and retract the telescoping sections.

20. The patient lifting and transport device of claim 1 including a lock interfacing with each vertical lift column and a respective mobile trolley, wherein the lock in effective to lock the mobile trolley with respect to the vertical lift column.

* * * * *